US005706987A

United States Patent [19]

Todd et al.

[11] Patent Number: 5,706,987

[45] Date of Patent: Jan. 13, 1998

[54] HOSIERY BOARDING MACHINE AND METHOD

[75] Inventors: William H. Todd, Winston-Salem; Joseph L. Collins, Jr., Clemmons; Thomas A. Reavis, King; George M. Bowman; Richard T. Simmons, both of Mount Airy, all of N.C.

[73] Assignee: Renfro Corporation, Mount Airy, N.C.; a part interest

[21] Appl. No.: 669,835

[22] Filed: Jun. 26, 1996

Related U.S. Application Data

[63] Continuation of Ser. No. 440,090, May 12, 1995, abandoned.

[51] Int. Cl.[6] ..... D06C 5/00

[52] U.S. Cl. ..... 223/76; 223/75

[58] Field of Search ..... 223/75, 76, 77, 223/1; 28/295; 198/468.4

[56] References Cited

U.S. PATENT DOCUMENTS

| | | | |
|---|---|---|---|
| 3,486,471 | 12/1969 | De Spain | 223/75 |
| 3,960,276 | 6/1976 | Gerhardt | 198/468.4 |
| 4,166,556 | 9/1979 | Annas, Sr. | 223/76 |
| 4,550,868 | 11/1985 | Hodges et al. | 223/75 |
| 4,564,133 | 1/1986 | Gazzarrini | 223/75 |
| 4,703,877 | 11/1987 | Kuniki et al. | 223/76 |
| 4,748,923 | 6/1988 | Walton et al. | 198/468.4 |
| 4,919,315 | 4/1990 | Nakano | 223/76 |
| 5,004,132 | 4/1991 | Hollowell et al. | 23/295 |
| 5,094,371 | 3/1992 | Takamura et al. | 223/76 |

FOREIGN PATENT DOCUMENTS

| | | | |
|---|---|---|---|
| 1087105 | 8/1960 | Germany | 223/76 |
| 545446 | 5/1942 | United Kingdom | 223/76 |

*Primary Examiner*—Bibhu Mohanty

[57] ABSTRACT

An automatic boarding machine and method provides convenience, precision and efficiency of operation. Boarding forms are horizontally positioned for easy loading and ergonomic advantage. Microprocessor controls allow variable speed and cycle times while independent temperature controls permit precise temperature adjustments for a series of thermal pressers. The boarding machine is configured to provide space saving circular movement of a plurality of forms which pass sequentially through a moisture treatment, heated presses, and an unloader. The processed hosiery is then stacked on a conveyor, and excess yarn ends are removed by an electrical trimmer. A control panel allows the operator to change and adjust all phases of the operation easily and quickly to insure uniformity of the finished product.

12 Claims, 6 Drawing Sheets

HOSIERY BOARDING MACHINE AND METHOD

This application is a continuation of Ser. No. 08/440,090, filed May 12, 1995, now abandoned.

FIELD OF THE INVENTION

The invention herein pertains to boarding and processing hosiery and particularly pertains to automatic equipment for horizontally boarding socks. The equipment positively indexes socks which are placed on a revolving form for precise heat setting, after which they are removed, stacked, and trimmed for subsequent packaging.

BACKGROUND AND OBJECTIVES OF THE INVENTION

It is well known in the hosiery industry to place finished socks and other hosiery items such as pantyhose, knee-high's, and the like on vertical boarding forms which pass through a heating chamber where the socks are heat-set to an approximate size and shape. Manual loading and unloading on conventional boarding forms requires a strenuous effort by operators who must repeatedly raise their arms to load and unload the vertical forms as they move along a conveyor arrangement. Once the socks have been through the boarding process, they are then generally, manually removed and trimmed, one sock at a time, and are then manually selected and paired with a similar size mate for packaging purposes.

Often, socks vary in size after conventional boarding since the heat settings and boarding processes are not precisely controlled. Workers must then select one sock and decide which other sock to pair with it to provide consistency and uniformity for the consumer package.

Thus, with the problems and disadvantages of prior art boarding equipment, techniques, and the results obtained, the present invention was conceived and one of its objectives is to provide a hosiery boarding machine which is precisely indexed through various stages and carefully controlled to ensure constant uniformity in the finished socks.

It is another objective of the present invention to provide hosiery boarding equipment which includes boarding forms which rotate horizontally.

It is yet another objective of the present invention to provide boarding equipment with a microprocessor controlled method utilizing pneumatic cylinders for boarding hosiery.

It is also an objective of the present invention to provide hosiery boarding equipment which includes a key pad for data input to ensure precise adjustments and control of the boarding operation.

It is a further objective of the present invention to provide a boarding apparatus which turns and indexes in a horizontal plane through a series of heat presses, and an automatic unloader.

It is an additional objective of the present invention to provide hosiery boarding equipment which includes a vacuum operated sock stacking apparatus.

It is still another objective of the present invention to provide a hosiery boarding form which will automatically extend excess yarns from the socks during removal for ease in trimming.

It is another objective of the present invention to provide a hosiery boarding machine having an automatic yarn trimmer to remove excess yarn ends from the socks.

Various other advantages and objectives of the present invention will become apparent to those skilled in the art as a more detailed description is set forth below.

SUMMARY OF THE INVENTION

The invention herein provides an apparatus and a method for boarding hosiery in which socks or the like are automatically processed in a precise, selectively controllable, uniform manner. A plurality of boarding forms are horizontally positioned on a central hub which indexes according to preselected parameters which insures accurate movements in exact time periods. Movements can be changed and varied through an operator controlled panel which is in communication with a microprocessor contained in a main control housing at a remote location. The boarded socks pass through a water mist or steam (moisture) application if necessary horizontally and then revolve in sequence to three heated pressers which have independent temperature controlled upper and lower platens. The boarded socks are then removed from the boarding forms by an unloader which carefully extracts the socks after which a conveyor delivers the socks to a vacuum operated stacking device. The stacking device transfers the socks from the unloading conveyor to a trimming conveyor, one at a time until a selected number of socks, such as for example 12, are stacked. The stacked socks are conveyed to a pneumatically operated stop or gate which exactly terminates movement of the socks and a second pneumatically operated gate is lowered to precisely align the stacks on the halted conveyor. A pressure foot lowers to secure the socks while an electrical trimmer then makes passes across the cuff end of the sock to remove excess yarns earlier withdrawn. The pressure foot then releases and allows the stacked socks to again move along the activated conveyor for packaging, labeling, or the like. The method employed provides temperatures and all other movements to be precisely, conveniently controlled by the main microprocessor from the operator control panel, or the main control panel as desired.

DETAILED DESCRIPTION OF THE PREFERRED EMBODIMENTS OF THE INVENTION

Figure 1:
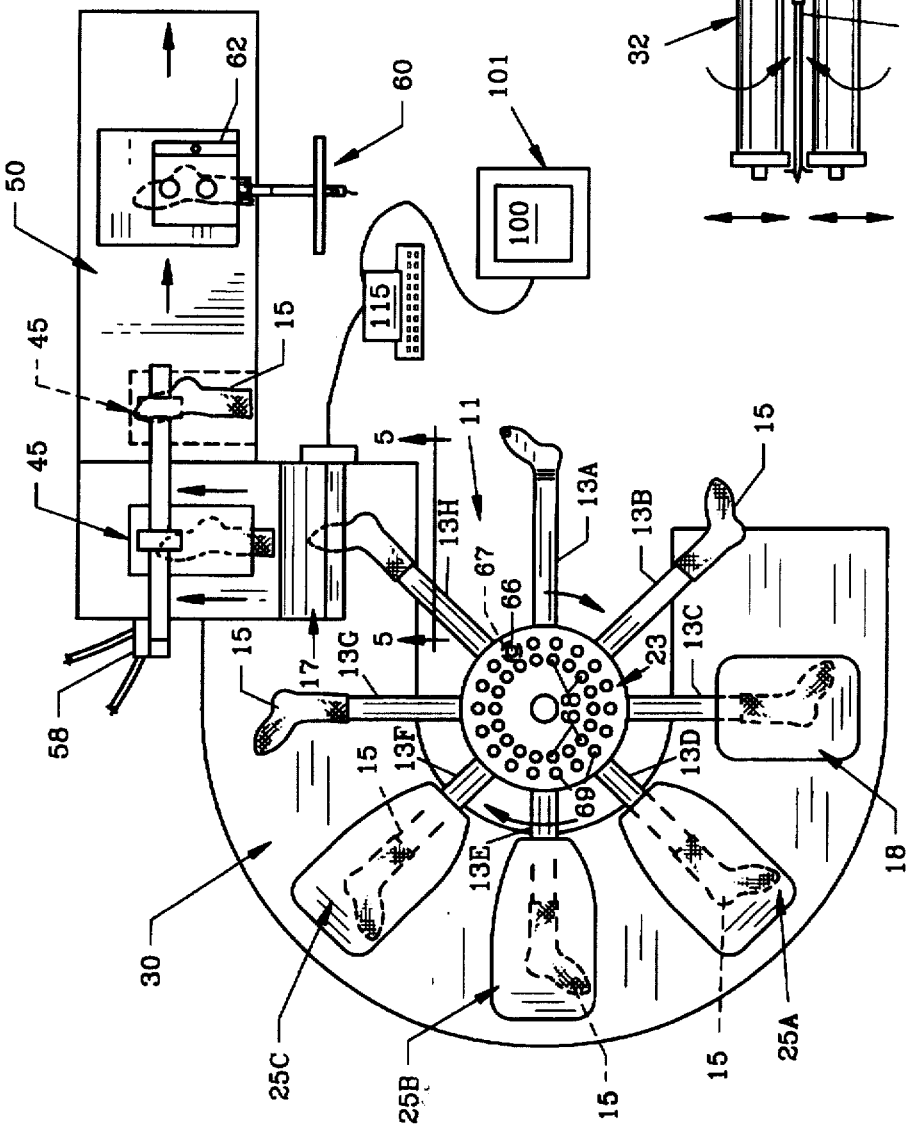
FIG. 1 demonstrates an overall plan view of the hosiery boarding machine of the invention.

For a better understanding of the invention and its method of operation, turning now to the drawings, FIG. 1 illustrates hosiery boarding machine 10 in the preferred form whereby form assembly 11 includes a circular hub 23 to which eight (8) horizontal, identical boarding forms 13A–13H are attached. Boarding forms 13A–13H may be manufactured from a lightweight metal such as aluminum and extend from hub 12 approximately 90 centimeters. Boarding forms 13A–13H which are the preferred configuration, are sized to accommodate adult male socks 15 as known in the industry. However, various sizes and shapes of boarding forms can be manufactured and substituted on hub 12 to accommodate other articles of hosiery, including pantyhose, knee-high stockings, children's socks, and other products conventional in the trade. Boarding forms 13A–13H, with 13A shown enlarged in FIG. 2 include a series of ridges 14 having a "rough" top edge which extend outwardly from the calf area on both the top and bottom surfaces.

Figure 3:
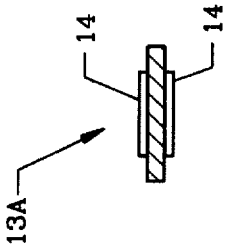
FIG. 3 shows a cross-sectional view of the hosiery boarding form as shown in FIG. 2 along lines 3—3.
Figure 2:
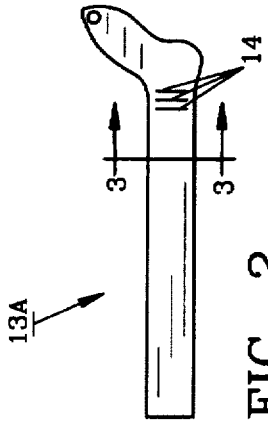
FIG. 2 illustrates a single boarding form removed therefrom.

FIG. 3 demonstrates in enlarged fashion along lines 3—3 of FIG. 2, the projection of ridges 14 which act to "grab" any excess yarn within socks 15 (FIG. 1) during unloading from forms 13A–13H, as will be hereinafter explained in more detail.

Figure 9:
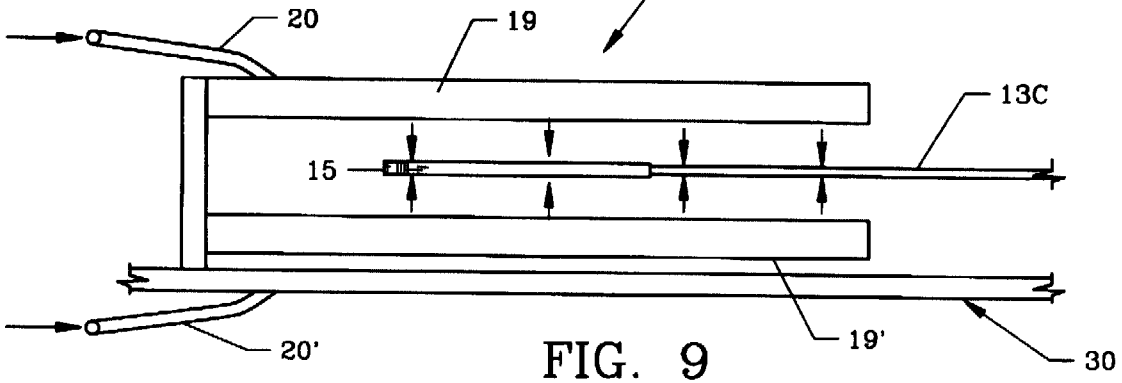
FIG. 9 shows a side view of the water mist or steam (moisture) applicator.

Boarding form assembly 11 as seen in FIG. 1 is programmed and controlled by microprocessor 102 (FIG. 13) whereby the processing of socks 15 is fully automated and can be selectively, precisely controlled during each step of the process. In use, boarding form 13A is manually loaded with hosiery such as sock 15 from a nearby cart (not seen) by a production employee or operator. As would be understood, form assembly 11 is preferably programmed to index in a clockwise direction at approximately three to five (3–5) second intervals. Thus as form 13A is loaded, it will thereafter move to the position as shown in FIG. 1 occupied by form 13B in a matter of seconds, whereby simultaneously form 13H, after being attended by unloader 17 which acts as a means to remove sock 15 therefrom, will rotate to the position shown by form 13A. As form assembly 11 moves in a circular path, moisture applicator 18 is first encountered by a loaded form (13C). Moisture applicator 18 as shown in an enlarged side elevation view in FIG. 9 includes a top moisture supply chamber 19 and a bottom moisture supply chamber 19' for distributing moisture, received through respectively, hoses 20, 20'. Hoses 20, 20' are joined to a conventional moisture source as is conventional in the trade. Moisture applicator 18 is used to supply moisture to boarded sock 15 although moisture may not be necessary on all types of hosiery.

Figure 4:
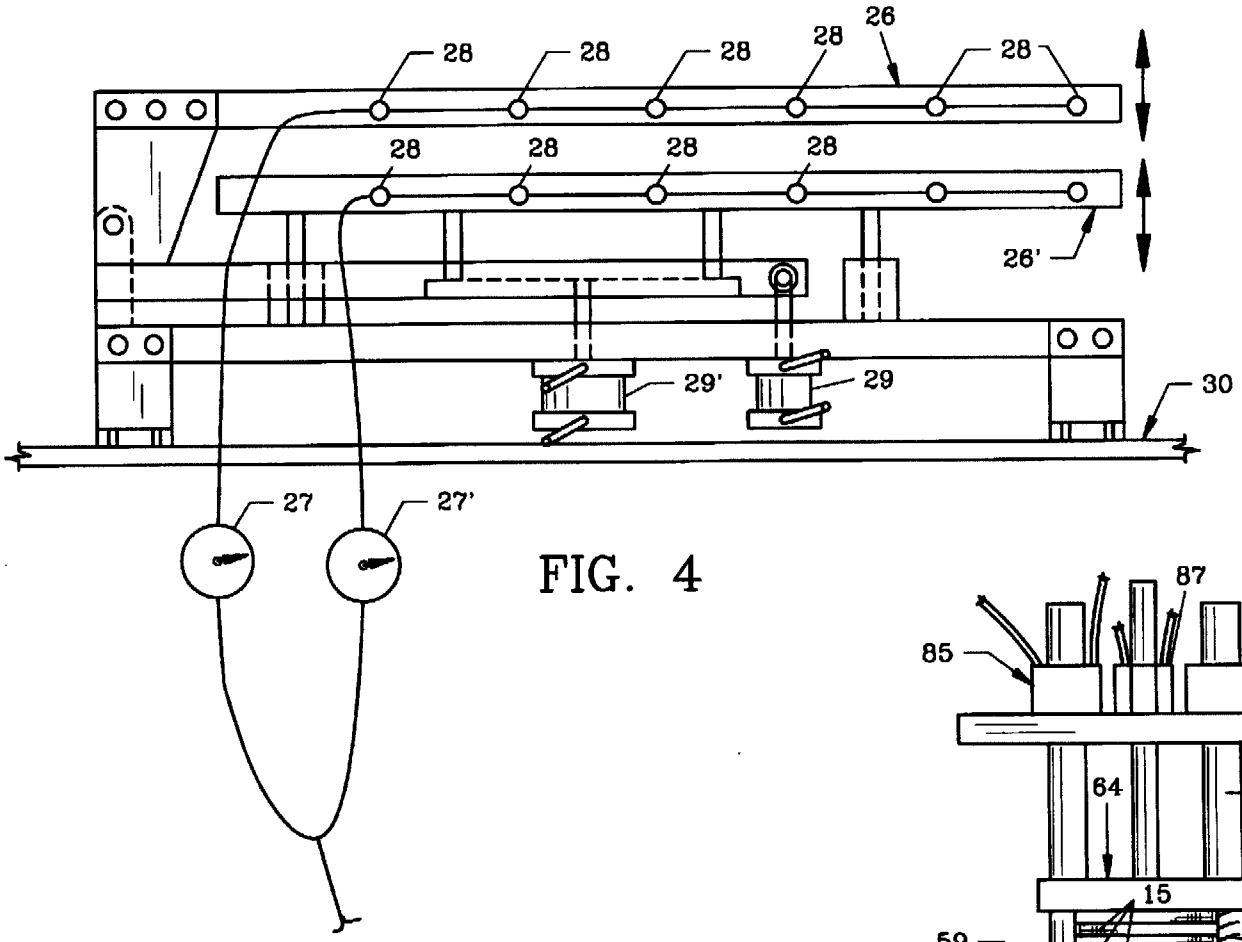
FIG. 4 depicts a side elevational view of a presser.
Figures 13, 14:
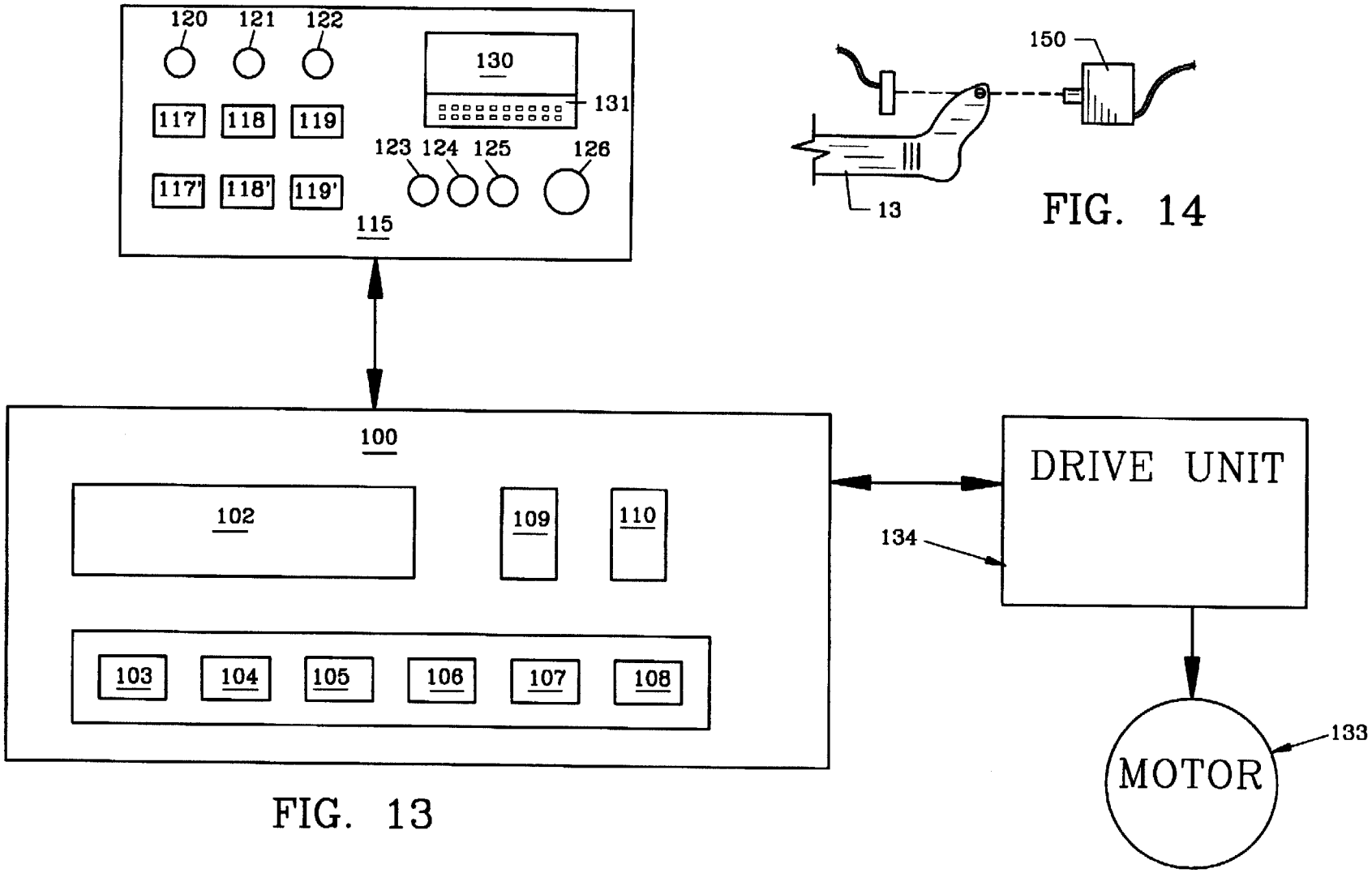
FIG. 13 demonstrates an electrical schematic in block fashion of the control panel and the form assembly drive motor.
FIG. 14 presents a schematic of the photoelectric cell positioned at the unloader.

After moisture has been applied to sock 15, form assembly 11 indexes whereby sock 15 then encounters a first heat application by presser 25A. As seen FIG. 1, pressers 25A, 25B, and 25C are identical and are arcuately positioned along table 30. In FIG. 4, an enlarged side elevational view of presser 25A is seen having a top platen 26 and a bottom platen 26' which are independently movable with the temperature of each platen independently controlled by thermostats 27, 27' respectively which are connected to operator panel 115 (FIG. 13). Conventional calrod units 28 are contained in upper platen 26 and lower platen 26' to supply necessary heat. Pressing action is performed by pneumatic cylinders 29, 29' which act respectively on upper platen 26 and lower platen 26'. During operation, both upper platen 26 and lower platen 26' open or move apart to allow boarding form such as 13D as shown in presser 25A (FIG. 1) to enter. Pressers 25A, 25B, and 25C are adjustable for a proper "gap" between platens, and the pressure applied by said platens is also adjustable. Thereafter, the pneumatic action of cylinders 29, 29' operate to close against and heat sock 15 therein. Once the described pressing action is terminated, form assembly 11 is indexed to presser 25B and thereafter to presser 25C. Three pressing operations have been found to ensure an even, uniform sock which, in its final form, is consistent in size and shape, a primary importance during the subsequent stages of hosiery processing, including packaging. One or more pressing operations may be necessary for particular hosiery, depending on the specific yarn type, size, and hosiery construction utilized.

Figure 5:
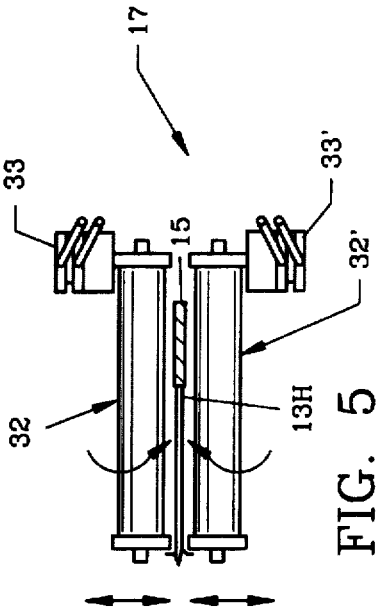
FIG. 5 pictures a front view of the unloader as used in the invention.
Figure 8:
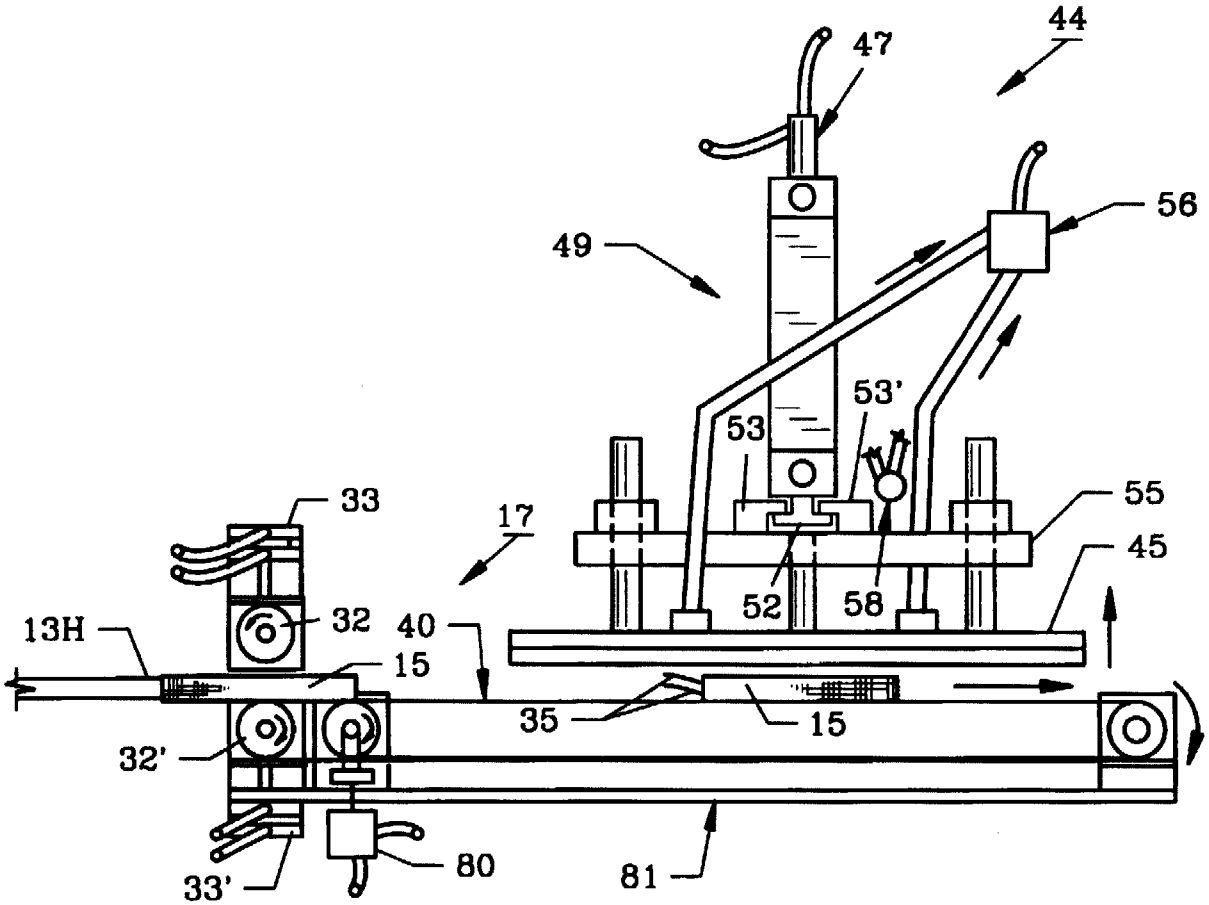
FIG. 8 illustrates another view of the stacker as shown in FIG. 6.

Once sock 15 has exited presser 25C, it is subsequently cooled, shown by boarding form 13G, and is next rotated to hosiery unloader 17 as shown in FIGS. 5 and 8. Unloader 17 includes top roller 32 and bottom roller 32' which are vertically aligned and closed by pneumatic cylinders 33, 33' respectively. As shown in FIG. 5, sock 15 on boarding form 13H has been rotated to a position between rollers 32 and 32'. Next, pneumatic cylinders 33 and 33' urge rollers 32 and 32' together, into contact with sock 15. Rollers 32 and 32' then turn as indicated by arrows in FIGS. 5 and 8 to remove sock 15 from boarding form 13H. Cylinders 33, 33' then separate rollers 32 32' and form assembly 11 then indexes to the next position as shown by boarding form 13A (FIG. 1) where an operator again loads boarding form 13A with a new sock 15 for the next cycle. If no sock is positioned on boarding form 13 as seen in FIG. 14, photoelectric cell 150 is activated which signals microprocessor 102 (FIG. 13) which in turn prevents closing of rollers 32 and 32'.

Figure 6:
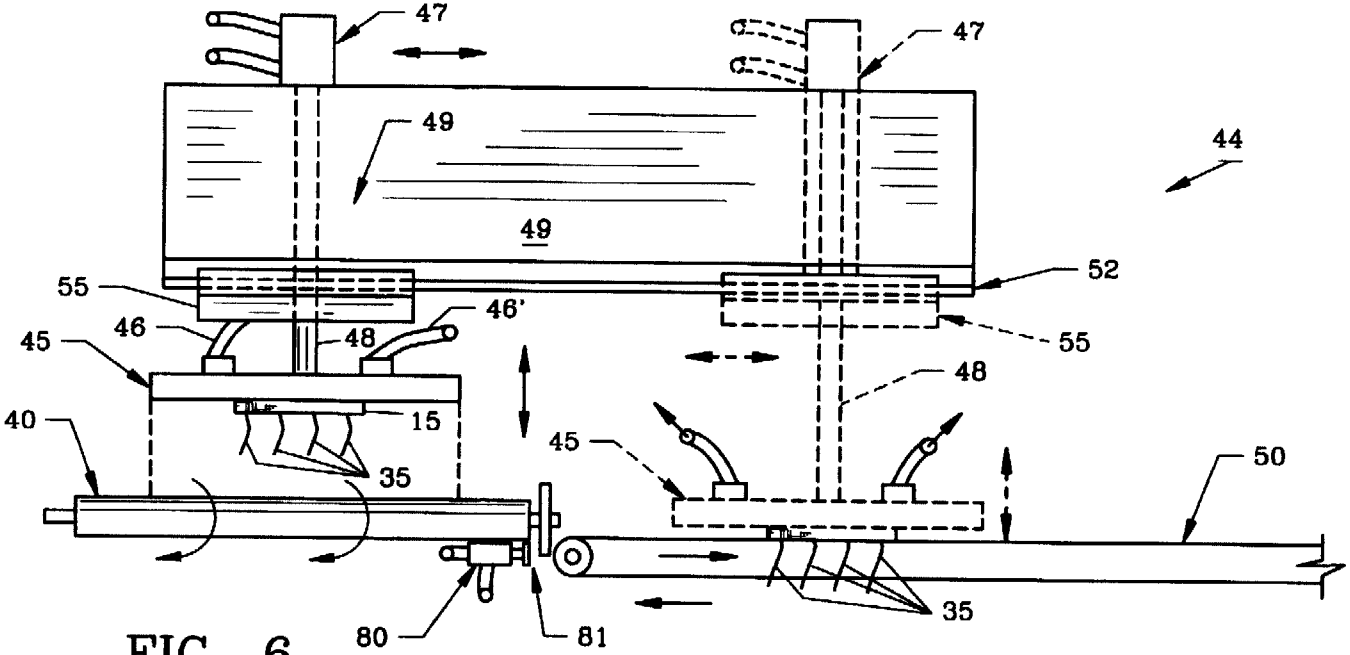
FIG. 6 presents a side representation of the stacking apparatus and conveyors of the invention.

Sock 15, which may be knit by usual methods, contains excess yarn ends 35 within sock 15, particularly near the cuff area. As sock 15 is unloaded from boarding form 13H as shown in FIG. 1, ridges 14 cause excess yarn ends 35 contained within sock 15 to be pulled out of the cuff where the exposed ends 35 remain until trimming. Excess yarn ends 35 are shown in FIG. 8 as conveyor 40 delivers socks 15 from unloader 17 to below stacker 44. Another view of stacker 44 is seen in FIG. 6 whereby sock 15 has been lifted from conveyor 40 by vacuum plate 45. As shown, vacuum plate 45 is connected by pneumatic lines 46, 46' to a suitable vacuum source (not shown). Vacuum plate 45 is lifted and lowered by pneumatic cylinder 47 through cylinder rod 48. Vacuum plate 45 lifts sock 15 from conveyor 40 and delivers it (from left to right in FIG. 6) to trimmer conveyor 50. Vacuum plate 45 and pneumatic cylinder 47 move laterally along bottom rail 52 as seen in FIG. 8. Rail guides 53, 53' are affixed to vacuum plate support 55 and allow suspension of vacuum plate 45 from rail 52, for movement therealong.

Figure 7:
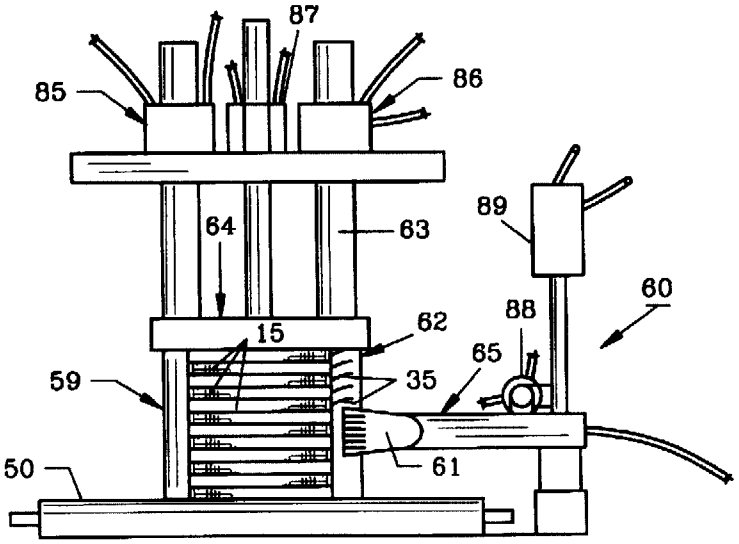
FIG. 7 demonstrates the pressure foot and trimming apparatus of the invention.

As socks 52 are stacked at a selected height on trimmer conveyor 50 as seen in FIG. 1, they are subsequently moved from left to right, as in a stack of 12, for trimming and packaging purposes. Stacked socks 15 encounter movable stop gate 62 as shown in FIG. 7 which is lowered and raised by cylinder rod 63 attached to pneumatic cylinder 86. As stop gate 62 is lowered proximate conveyor 50, conveyor 50 terminates its movement. At the same time stop gate 62 is lowered, stop gate 59 perpendicular to stop gate 62 is lowered to square socks 15 relative to trimmer 65, by air cylinder 85. Next, pressure foot 64 is lowered against socks 15 to secure socks 15 in place for trimming, and gates 59 and 60 are raised.

With socks 15 so held by pressure foot 64, trimmer 65, which may be for example a pair of standard electric barber shears, moves along the cuff edge of socks 15 as shown in FIG. 7 to trim excess yarn ends 35 which have been extended as earlier described. Trimmer 65 may make two or more passes, depending on the height of socks 15 stacked therealong to complete the trimming process. Trimmer 65 moves in a straight, horizontal path along the cuffs of socks 15, then indexes upwardly a selected distance and again transverses a horizontal path along the cuffs. This transversing movement of trimmer 65 is repeated until all excess yarn ends have been trimmed. Thereafter, pressure foot 64 is lifted by pneumatic action of air cylinder 87 and the trimming cycle is subsequently repeated with another stack of socks 15 transported by conveyor 50. After trimming, socks 15 are directed along conveyor 50 to other packaging equipment which may bag, label or otherwise confine the socks for sales and distribution purposes.

Figure 10:
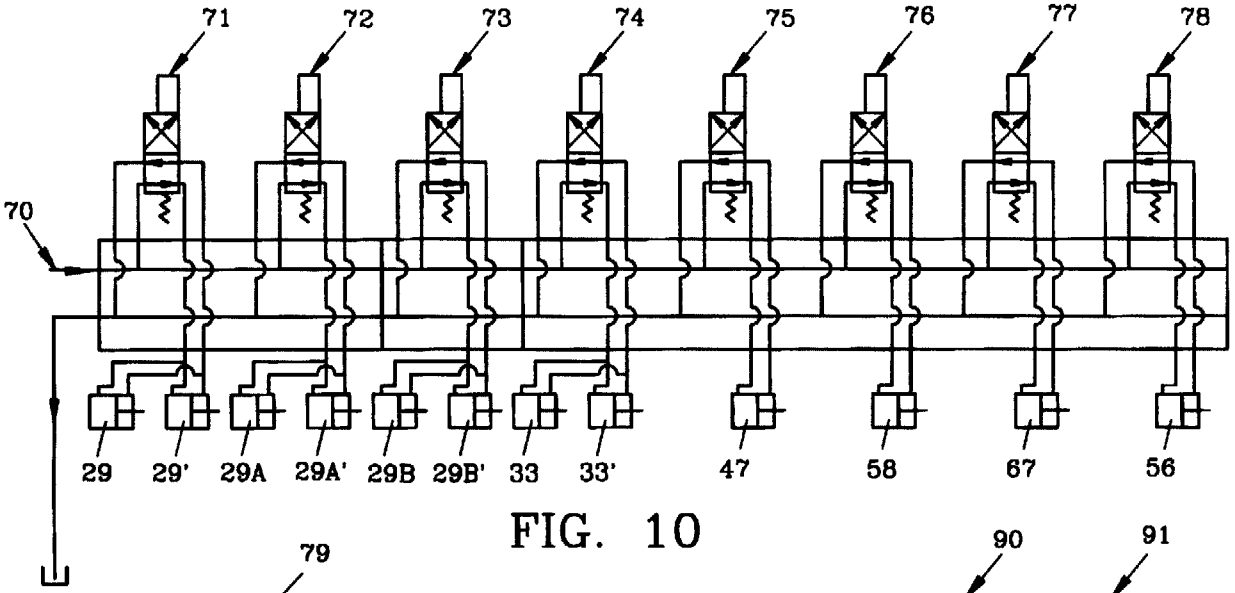
FIG. 10 depicts a schematic of certain of the pneumatic components.
Figure 12:
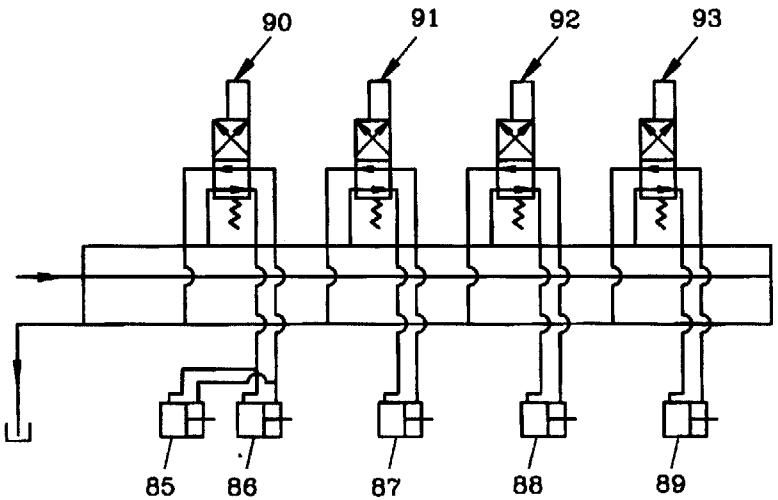
FIG. 12 presents the pneumatic components as used with the pressure foot and trimming apparatus of the invention.
Figure 11:
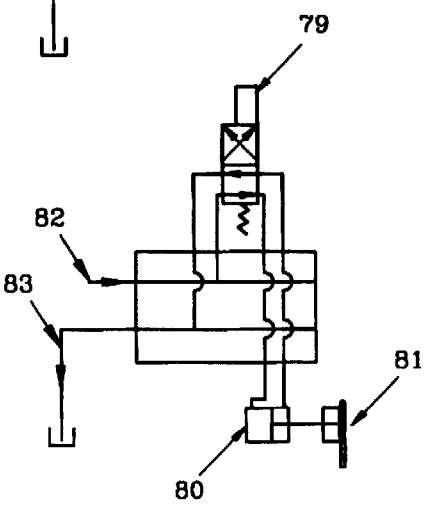
FIG. 11 pictures a schematic representation of the pneumatic components for the unloader conveyor brake.

FIGS. 10, 11, and 12 illustrate the preferred pneumatic scheme of the invention. As shown, in FIG. 10, 80 psi air is connected to air line 70 from a conventional compressor or other source. Solenoid 71, which is connected to main control panel 100, controls pneumatic cylinders 29, 29' of, respectively, top platen 26 and bottom platen 27 of presser 25A as shown in FIG. 4. Likewise, solenoids 72, 73 similarly control pneumatic cylinders 29A, 29A' of presser 25B and solenoid 73 controls air cylinders 29B, 29B' which are connected to, respectively, the top and bottom platens (not seen) of presser 25C. As would be understood, pressers 25 A, B, and C are identical and are independently thermally regulated. Solenoid 74 seen in FIG. 10 controls air cylinders 33, 33' which operate rollers 32, 32' of sock unloader 17 shown more detail in FIG. 8. Solenoid 75 controls pneumatic cylinder 47, also shown in FIG. 8 which raises and lowers vacuum plate 45.

In addition, solenoid 76 controls air cylinder 58 which directs the horizontal movement of vacuum plate 45 to deliver socks from conveyor 40 to trimmer conveyor 50. Solenoid 77 controls air cylinder 67 (FIG. 1) shown beneath form assembly 11. Air cylinder 67 provides a locking finger 66 which is inserted into opening 68 of form assembly hub 23. As would be understood, air cylinder 67 attached to finger 66 engages opening 68 for "positive" positioning of form assembly 11 during rotation. Openings 69 are spaced outwardly from openings 68 whereby the rotational movement can be varied by adjusting air cylinder 67 to engage either opening 68 for less movement or opening 69 for more movement. Other openings may likewise be formed in hub 23 of form assembly 11 for greater adjustment options. Solenoid 78 controls vacuum on/off cylinder 56 as shown in FIG. 8 which allow vacuum plate 45 to apply suction as shown therein for moving and stacking socks 15.

In FIG. 11, solenoid 79 is shown which controls brake apparatus 81 of conveyor 40. Brake apparatus 81 is schematically shown in FIG. 6 which precisely terminates the movement of conveyor 40. Brake appartus 81, in conjunction with locking cylinder 67, provides precise movement and precise indexing of hosiery boarding machine 10. 80 psi air enters brake cylinder inlet line 82 from a conventional supply source and is exhausted through line 83.

In FIG. 12, solenoid 90 activates gate cylinders 85, 86 as shown in FIG. 7 drive respectively stop gate 59, 62 as shown in FIG. 7. Stop gates 59, 62 "square" socks 15 on conveyor 50 whereby trimmer 65 can accurately trim excess yarn ends 35 therefrom as earlier explained. As pressure foot 64 which is activated by solenoid 91 and driven by air cylinder 87 lowers, socks 15 are maintained in place for trimming. Solenoid 92 controls horizontal trimmer travel air cylinder 88 whereas solenoid 93 controls air cylinder 89 which directs the vertical travel of trimmer 65. As would be understood, trimmer head 61 is of a width or height less than the height of socks 15 as shown in FIG. 7. Thus, trimmer 65 must make a plurality of passes along the cuffs of socks 15 to trim excess yarn ends 35. Air cylinders 88, 89 provide the necessary horizontal and vertical trimmer movement to create the trimming path required for the stacked socks 15. The path of trimmer 65 can be changed and controlled at operator panel 115.

In FIG. 13, a schematic block diagram of the electrical components and controls are seen whereby main control panel 100 is connected to operator panel 115. As shown in FIG. 1, main control housing 101 includes main control panel 100. Main control panel 100 as seen in FIG. 13 contains programmable microprocessor 102 which is a logic controller for hosiery boarding machine 10. Form assembly 11 is turned by a fractional horsepower stepper motor 133 connected to hub 23 and is controlled by conventional drive unit 134. Drive unit 134 provides a stepping function for motor 133 and is controlled by programmable logic controller 102. Also included in main control housing 101 are solid state relays (not shown), each connected to heating relay switches 103–108 seen in FIG. 12 on main control panel 100. Switches 103–108 are connected to, respectively, pressers 25A–25C to activate calrod units 28 therein (FIG. 4). Motor switch 109 controls the fractional horsepower motor (not shown) which drives conveyor 40, whereas motor switch 110 controls a similar fractional horsepower motor (not shown) which drives conveyor 50.

Operator panel 115 is electrically connected to main control housing 101 and is positioned for easy availability by the operator of boarding machine 10. Operator panel 115 includes temperature dials 117, 117' which respectively adjust the temperature for top platen 26 and bottom platen 26' of presser 25A. Likewise, temperature dials 118, 118' and 119, 119' respectively have LED readouts for the top and bottom platens of pressers 25B and 25C, for individual adjustment thereof. Switches 120–122 respectively are on/off switches for pressers 25A–25C. Manual push-button switches 123–126 consist of respectively reset, stop, start and emergency-stop switches for boarding machine 10. Emergency stop switch 126 is larger for convenient identification and use in crisis situations.

Also shown on operator panel 115 is display screen 130, provided with key pad 131 for input purposes. Display 130 will also display the various machine functions and provide the user with an interface to microprocessor 102. Thus, the operator can adjust the various temperatures, indexing speeds, air cylinder operations and the like from a convenient position proximate form assembly 11 as shown in FIG. 1 from operator panel 115.

The illustrations and examples provided herein are for explanatory purposes and are not intended to limit the scope of the appended claims.

We claim:

1. A machine for boarding hosiery, unloading the hosiery onto a first conveyor, stacking the hosiery onto a second conveyor, and trimming loose yarn ends extending from within the hosiery, said boarding machine comprising:

(a) a rotatable form for boarding hosiery, said boarding form configured to shape the hosiery for packaging, said boarding form extending lengthwise in a horizontal plane;

(b) means for driving said horizontal boarding form, said driving means joined to said horizontal boarding form;

(c) a hub, said boarding form attached to said hub, said boarding form rotatable in a horizontal plane about said hub;

(d) a microprocessor, said microprocessor connected to said driving means;

(e) means for heat setting the boarded hosiery, said heat setting means positioned proximate said boarding form to apply heat thereto;

(f) an unloader, said unloader positioned proximate said boarding form to unload hosiery from said boarding form, said unloader comprising a top roller and a bottom roller, said rotatable form positionable between said top and bottom rollers, said top and bottom rollers movable into contact with said rotatable form;

(g) means for stacking hosiery, said stacking means positioned proximate the first conveyor, said stacking means comprising a vacuum plate, a cylinder rod and a rail, said vacuum plate slidably carried by said cylinder rod and said rail, said vacuum plate slidable along said cylinder rod to lift said hosiery from the first conveyor, said vacuum plate slidable along said rail to transfer the hosiery to the second conveyor; and (h) means for trimming excess yarn ends from the hosiery, said trimming means positioned proximate the second conveyor, said trimming means comprising a first stop gate, a second stop gate, a pressure foot, and a trimmer.

2. The boarding machine as claimed in claim 1 and including means for applying moisture, said moisture applying means positioned proximate said horizontal boarding form to interact therewith.

3. The boarding machine as claimed in claim 1 wherein said boarding form comprises a ridge, said ridge for engaging the yarn ends and pulling the yarn ends from within the hosiery when the hosiery is unloaded from the boarding form.

4. The boarding machine as claimed in claim 1 wherein said driving means comprises an electric motor.

5. The boarding machine as claimed in claim 1, further comprising a main control panel, said microprocessor contained by said main control panel.

6. The boarding machine as claimed in claim 5, further comprising an operator panel, said operator panel electrically connected to said main control panel.

7. The boarding machine as claimed in claim 5, further comprising a solid state relay, said solid state relay contained by said main control panel.

8. The boarding machine as claimed in claim 5, further comprising a display screen and a key pad, said key pad connected to said display screen, said display screen contained by said operator panel.

9. The boarding machine as claimed in claim 8, wherein said key pad interfaces said microprocessor.

10. The boarding machine as claimed in claim 1, wherein said means for heat setting boarded hosiery comprises a thermal presser.

11. The boarding machine as claimed in claim 10, wherein said thermal presser is pneumatically controlled.

12. The boarding machine of claim 1, wherein said heat setting means is thermally adjustable.

* * * * *